US008360157B2

(12) United States Patent
Yale et al.

(10) Patent No.: US 8,360,157 B2
(45) Date of Patent: Jan. 29, 2013

(54) SLURRIFIED HEAVY OIL RECOVERY PROCESS

(75) Inventors: David P Yale, Milford, NJ (US); Eric Herbolzheimer, Green Brook, NJ (US)

(73) Assignee: ExxonMobil Upstream Research Company, Houston, TX (US)

( * ) Notice: Subject to any disclaimer, the term of this patent is extended or adjusted under 35 U.S.C. 154(b) by 769 days.

(21) Appl. No.: 12/083,028

(22) PCT Filed: Aug. 11, 2006

(86) PCT No.: PCT/US2006/031479

§ 371 (c)(1),
(2), (4) Date: Apr. 2, 2008

(87) PCT Pub. No.: WO2007/050180

PCT Pub. Date: May 3, 2007

(65) Prior Publication Data

US 2009/0236103 A1 Sep. 24, 2009

Related U.S. Application Data

(60) Provisional application No. 60/729,973, filed on Oct. 25, 2005.

(51) Int. Cl.
*E21B 43/00* (2006.01)
*E21B 43/16* (2006.01)

(52) U.S. Cl. ..... 166/370; 166/400; 166/245

(58) Field of Classification Search ..... 299/2, 3, 299/4, 17; 166/370, 400, 275
See application file for complete search history.

(56) References Cited

U.S. PATENT DOCUMENTS 3,113,617 A 12/1963 Oakes (Continued)

OTHER PUBLICATIONS

Overfield, R. E., Cave, G. J., Sharpe, J. A., and Wong, R. C. K. (1993) "Borehole mining in Athabasca and Cold Lake" (details of reference not known).

(Continued)

*Primary Examiner* — Angela M DiTrani
(74) *Attorney, Agent, or Firm* — ExxonMobil Upstream Research Company Law Department

(57) ABSTRACT

In at least one specific embodiment, a method for recovering heavy oil includes accessing, from two or more locations, a subsurface formation having an overburden stress disposed thereon, the formation comprising heavy oil and one or more solids. The formation is pressurized to a pressure sufficient to relieve the overburden stress. A differential pressure is created between the two or more locations to provide one or more high pressure locations and one or more low pressure locations. The differential pressure is varied within the formation between the one or more high pressure locations and the one or more low pressure locations to mobilize at least a portion of the solids and a portion of the heavy oil in the formation. The mobilized solids and heavy oil then flow toward the one or more low pressure locations to provide a slurry comprising heavy oil and one or more solids. The slurry comprising the heavy oil and solids is flowed to the surface where the heavy oil is recovered from the one or more solids. The one or more solids are recycled to the formation.

61 Claims, 8 Drawing Sheets

U.S. PATENT DOCUMENTS

| | | | | | |
|---|---|---|---|---|---|
| 3,407,003 | A | | 10/1968 | Durie | |
| 3,455,383 | A | | 7/1969 | Prats et al. | |
| 3,951,457 | A | | 4/1976 | Redford | |
| 4,078,608 | A | * | 3/1978 | Allen et al. | 166/266 |
| 4,092,045 | A | | 5/1978 | Sullivan | |
| 4,182,416 | A | | 1/1980 | Trantham et al. | |
| 4,212,353 | A | | 7/1980 | Hall | |
| 4,234,232 | A | | 11/1980 | Smith et al. | |
| 4,305,463 | A | * | 12/1981 | Zakiewicz | 166/245 |
| 4,362,212 | A | | 12/1982 | Schulz | |
| 4,372,383 | A | | 2/1983 | Ames | |
| 4,398,769 | A | | 8/1983 | Jacoby | |
| 4,437,706 | A | | 3/1984 | Johnson | |
| 4,527,836 | A | | 7/1985 | Uhri | |
| 4,583,784 | A | | 4/1986 | Uhri | |
| 5,249,844 | A | | 10/1993 | Gronseth | |
| 5,823,631 | A | | 10/1998 | Herbolzheimer et al. | |
| 5,879,057 | A | | 3/1999 | Schwoebel et al. | |
| 6,152,356 | A | | 11/2000 | Minden | |
| 6,460,936 | B1 | | 10/2002 | Abramov et al. | |

OTHER PUBLICATIONS

Sharpe, J. A., Shinde, S. B., Wong, R. C. (1997) "Cold Lake borehole mining", Jour. Canadian Petroleum Tech., vol. 36, pp. 58-63.

Wong, R. C. K. (1996) "Behaviour of water-jet mined caverns in oil sand and shale", Canadian Geotechnical Jour., vol. 33, pp. 610-617.

Parks, J. M. (1991) "New dredging technology for inlets and beaches: move sand to the pump", Coastal Sediments '91—ASCE, Seattle, Jun. 1991.

Niven, R. K. and Khalili, N. (1998) "In-situ fluidization by a single internal vertical jet", J. Hydraulic Res., vol. 36, pp. 199-228.

Weisman, R. N., Lennon, G. P., and Roberts, E. W. (1988) "Experiment on fluidization in unbounded domains", Jour. Hydraulic Engineering, vol. 114, pp. 502-515.

Tremblay, B., Sedgwick, G., and Forshner, K. (1997) "Simulation of cold production in heavy oil reservoirs: Wormhole dynamics", SPE Reservoir Engineering, May 1997, pp. 110-117.

* cited by examiner

SLURRIFIED HEAVY OIL RECOVERY PROCESS

This application is the National Stage of International Application no. PCT/US06/31479 filed Aug. 11, 2006 which claims the benefit of U. S. Provisional Application No. 60/729,973 filed on Oct. 25, 2005.

FIELD OF THE INVENTION

Embodiments of the invention relate to in-situ recovery methods for heavy oils. More particularly, embodiments of the invention relate to water injection methods for heavy oil recovery from sand and clay.

BACKGROUND OF THE INVENTION

Description of the Related Art

Bitumen is a highly viscous hydrocarbon found in porous subsurface geologic formations. Bitumen is often entrained in sand, clay, or other porous solids and is resistant to flow at subsurface temperatures and pressures. Current recovery methods inject heat or viscosity reducing solvents to reduce the viscosity of the oil and allow it to flow through the subsurface formations and to the surface through boreholes or wellbores. Other methods breakup the sand matrix in which the heavy oil is entrained by water injection to produce the formation sand with the oil; however, the recovery of bitumen using water injection techniques is limited to the area proximal the bore hole. These methods generally have low recovery ratios and are expensive to operate and maintain.

In another approach, the method described in commonly assigned U.S. Pat. No. 5,823,631 utilizes separate bore holes for water injection and production. That method first relieves the overburden stress on the formation through water injection and then causes the hydrocarbon-bearing formation to flow from the injection bore hole to the production bore hole from which the heavy oil, water, and formation sand is produced to the surface. Once the heavy oil is removed from the formation sand, the hydrocarbon-free sand is reinjected with water to fill the void left by the producing the slurry. Although the '631 method is a significant step-out improvement over conventional water injection techniques, there is still a need for further improved methods for continuously and cost-effectively recovering bitumen from subsurface formations.

SUMMARY OF THE INVENTION

Embodiments of the present invention provide improved methods for continuously and cost-effectively recovering heavy oils from subsurface formations.

In at least one specific embodiment, the method includes accessing a subsurface formation having an overburden stress disposed thereon from two or more locations, the formation comprising heavy oil and one or more solids. The formation is pressurized to a pressure sufficient to relieve the overburden stress. A differential pressure is created between the two or more locations to provide one or more high pressure locations and one or more low pressure locations. The differential pressure is varied within the formation between the one or more high pressure locations and the one or more low pressure locations to mobilize at least a portion of the solids and a portion of the heavy oil in the formation. The mobilized solids and heavy oil then flow toward the one or more low pressure locations to provide a slurry comprising heavy oil and one or more solids. The slurry comprising the heavy oil and solids is flowed to the surface where the heavy oil is recovered from the one or more solids. The one or more solids are recycled to the formation.

In at least one other specific embodiment, the method includes accessing, from two or more locations, a subsurface formation having an overburden stress disposed thereon, the formation comprising two or more hydrocarbon-bearing zones containing heavy oil and one or more solids; injecting a fluid into the formation at two or more depths within the formation and pressurizing at least one of the two or more hydrocarbon-bearing zones within the formation to a pressure sufficient to relieve the overburden stress; causing a differential pressure within the formation to provide one or more high pressure locations and one or more low pressure locations within the at least one of the two or more hydrocarbon-bearing zones within the formation; varying the differential pressure within the formation to mobilize at least a portion of the heavy oil and a portion of the one or more solids; causing the mobilized one or more solids and heavy oil to flow toward the one or more low pressure locations to provide a slurry comprising heavy oil and one or more solids; flowing the slurry comprising the heavy oil and one or more solids to the surface and recovering heavy oil from the slurry comprising heavy oil and one or more solids. Then recycling the one or more solids to the formation.

In yet another specific embodiment, the method includes accessing, from two or more locations, a subsurface formation having an overburden stress disposed thereon, the formation comprising two or more hydrocarbon-bearing zones containing heavy oil and one or more solids; injecting a fluid into the formation at two or more depths within the formation; pressurizing at least one of the two or more hydrocarbon-bearing zones within the formation to a pressure sufficient to relieve the overburden stress; causing a differential pressure within the formation to provide one or more high pressure locations and one or more low pressure locations within the at least one of the two or more hydrocarbon-bearing zones within the formation; varying the differential pressure within the formation to mobilize at least a portion of the heavy oil and a portion of the one or more solids, thereby providing mobilized one or more solids and heavy oil; causing the mobilized one or more solids and heavy oil to flow toward the one or more low pressure locations to provide a slurry comprising heavy oil and one or more solids; flowing the slurry comprising the heavy oil and one or more solids to the surface; recovering heavy oil from the slurry comprising heavy oil and one or more solids; and recycling the one or more solids to the formation.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
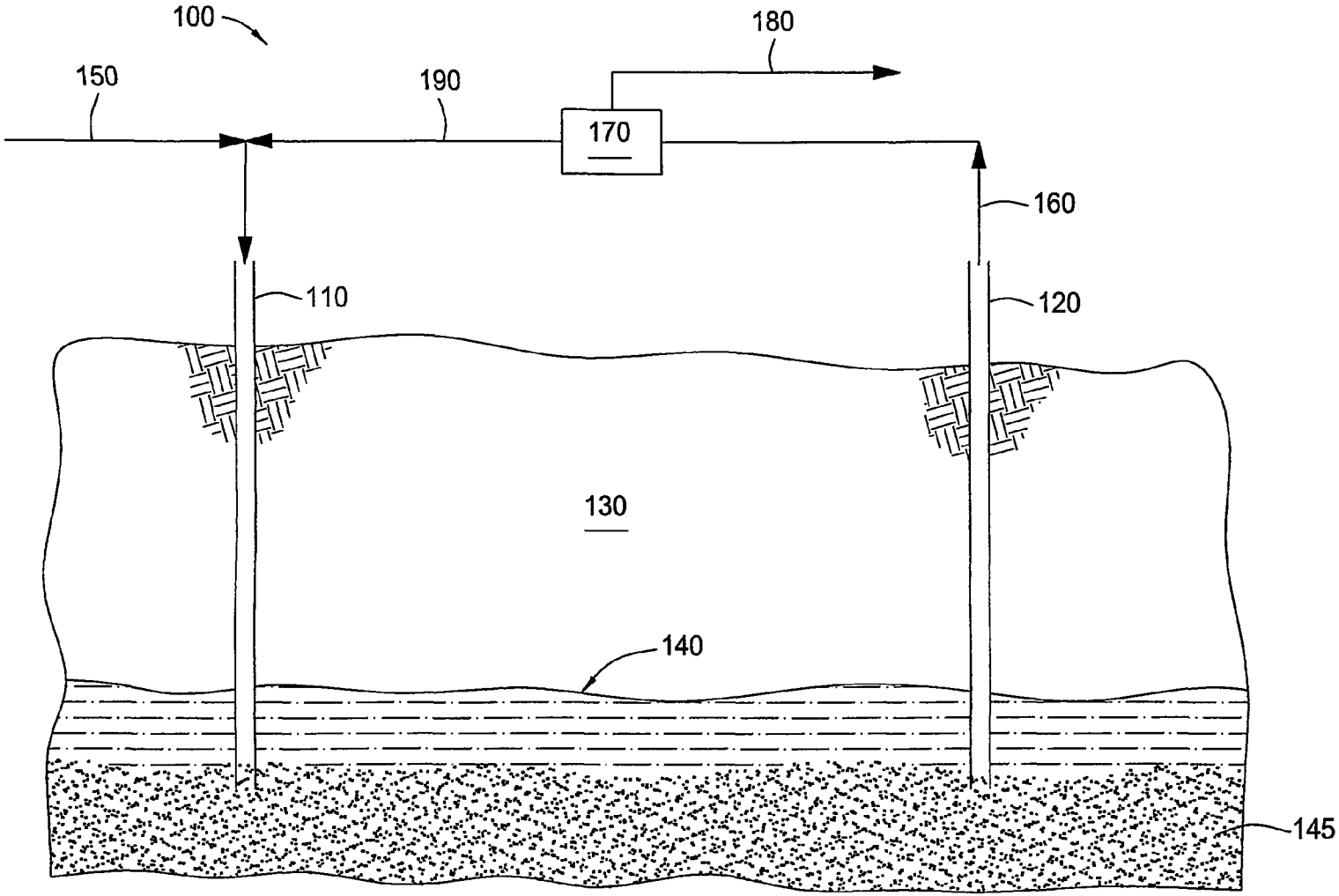
FIG. 1 is a schematic illustration of a cross-section (vertical slice) of a multi-wellbore system for producing heavy oil and sand slurry from a subsurface formation as described herein.

FIG. 1 is a schematic diagram of a multi-wellbore system 100 for producing heavy oil from a subsurface formation according to one or more embodiments described. The multi-wellbore system 100 can include two or more wellbores 110, 120 (only two shown). Each wellbore 110, 120 extends from the surface through the overburden 130 and accesses a formation 140 that includes one or more hydrocarbon-bearing zones 145 (only one shown) from which heavy oil is to be produced and recovered.

The term "heavy oil" refers to any hydrocarbon or various mixtures of hydrocarbons that occur naturally, including bitumen and tar. In one or more embodiments, a heavy oil has a viscosity of at least 500 cP. In one or more embodiments, a heavy oil has a viscosity of about 1000 cP or more, 10,000 cP or more, 100,000 cP or more, or 1,000,000 cP or more.

The term "formation" refers to a body of rock or other subsurface solids that is sufficiently distinctive and continuous that it can be mapped. A "formation" can be a body of rock of predominantly one type or a combination of types. A formation can contain one of more hydrocarbon-bearing zones.

The term "hydrocarbon-bearing zone" refers to a group or member of a formation that contains some amount of heavy oil. A hydrocarbon-bearing zone can be separated from other hydrocarbon-bearing zones by zones of lower permeability such as mudstones, shales, or shaley sands. In one or more embodiments, a hydrocarbon-bearing zone includes heavy oil in addition to sand, clay, or other porous solids.

The term "overburden" refers to the sediments or earth materials overlying the formation containing one or more hydrocarbon-bearing zones. The term "overburden stress" refers to the load per unit area or stress overlying an area or point of interest in the subsurface from the weight of the overlying sediments and fluids. In one or more embodiments, the "overburden stress" is the load per unit area or stress overlying the hydrocarbon-bearing zone that is being conditioned and/or produced according to the embodiments described.

The term "wellbore" is interchangeable with "borehole" and refers to a man-made space or hole that extends beneath the surface. The hole can be both vertical and horizontal, and can be cased or uncased. In one or more embodiments, a wellbore can have at least one portion that is cased (i.e. lined) and at least one portion that is uncased.

Referring to FIG. 1, an injection fluid is introduced to the hydrocarbon-bearing zone 145 through a first wellbore 110 ("injection wellbore") via stream 150. A production slurry exits the hydrocarbon-bearing zone 145 and is conveyed ("produced") through a second wellbore 120 ("production wellbore") via stream 160. The production slurry can include any combination (i.e. mixture) of heavy oil, clay, sand, water, and brine. The production slurry can be transferred via stream 160 to a recovery unit 170 where the heavy oil is separated and recovered from the solids and water. The recovery unit 170 can utilize any process for separating the heavy oil from the solids and water. Illustrative processes include cold water, hot water, and naphtha treatment processes, for example.

The recovered heavy oil (with possibly some residual solids and water) from the recovery unit 170 is then passed via stream 180 for further separation and refining using methods and techniques known in the art. The hydrocarbon-free or nearly hydrocarbon-free solids and recovered water from the recovery unit 170 can be recycled to the injection wellbore 110 via recycle stream 190, as shown in FIG. 1. The solids, water, or mixture of the solids and water can then be re-injected into the formation 140 via stream 150. Depending on process requirements, additional water or solids can be added to the recycle stream 190 or water or solids can be removed from the recycle stream 190 to adjust the solids concentration of stream 150 prior to injection through the wellbore 110 to the formation 140. Other fluids or solids including fresh sand or clay can also be added to the recycle stream 190 as needed.

Conditioning Phase

In operation, the injection fluid is pumped or otherwise conveyed through the injection wellbore 110 via stream 150 into the hydrocarbon-bearing zone 145 of the formation 140. One purpose of the injection fluid is to raise the fluid pressure in the formation 140 and relieve the overburden stress on the formation 140 (i.e. to "condition" the formation). Accordingly, the pressure of the injection fluid should be sufficient to relieve the overburden 130. Another purpose of the injection fluid is to increase the initial porosity of the formation 140 and therefore, increase the permeability of the formation 140 to the injected fluid (generally water or brine) as well as to partially or totally break up or disaggregate (through shear dilation) a portion of the shale or mudstone layers that may be embedded within the hydrocarbon-bearing zones 145 of the formation 140. This could remove those shale or mudstone layers from acting as baffles or barriers to the fluid flow within the formation 140 between the injection wellbore 110 and production wellbore 120.

Therefore, the pressure of the injection fluid should also be sufficient to permeate through the hydrocarbon-bearing zone 145 and develop a relatively constant pressure within the hydrocarbon-bearing zone 145 of the formation 140 at the end of conditioning. Preferably, the pressure of the injection fluid is at or above the stress of the overburden 130 exerted on the hydrocarbon-bearing zone 145 to allow the formation of horizontal or sub-horizontal fractures in the hydrocarbon-bearing zone. When the stress of the overburden 130 is relieved or nearly relieved throughout a majority of the volume of the hydrocarbon-bearing zone from which heavy oil production is planned, the hydrocarbon-bearing zone 145 is considered to be "conditioned."

Figure 2:
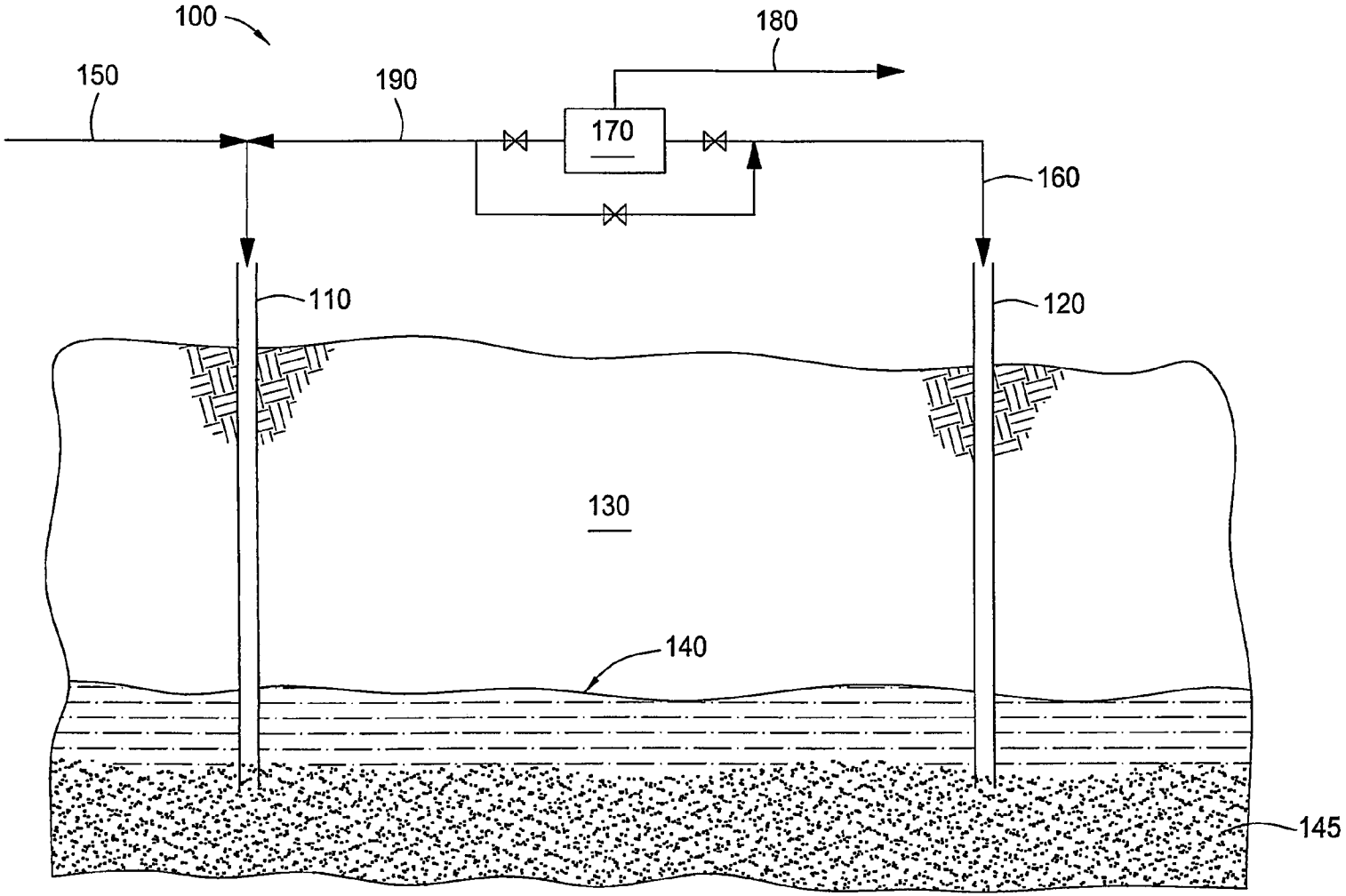
FIG. 2 is a schematic illustration of the multi-wellbore system 100 of FIG. 1 where injection fluid is passed through both wellbores for conditioning a formation.

FIG. 2 is a schematic illustration of an alternative embodiment of the multi-wellbore system 100 of FIG. 1 where injection fluid is passed through both wellbores 110 and 120 for conditioning the formation 140. The injection fluid can be injected into the hydrocarbon-bearing zone 145 through both the injection wellbore 110 and the production wellbore 120 to substantially reduce the time required to equalize the stress of the overburden 130, as shown in FIG. 2. For example, the time to relieve the stress of the overburden 130 can be reduced by as much as half or more.

Furthermore, the injection fluid can be injected into the hydrocarbon-bearing zone 145 through both the injection wellbore 110 and the production wellbore 120 to break or disaggregate (through shear dilation) a greater portion of the shale or mudstone layers that may be dispersed within the hydrocarbon-bearing zones 145 of the formation 140. At the very end of the conditioning process, the injection of fluid at a high rate through the production wellbore 120 can also help the early onset of slurry production through the production wellbore 120 by breaking up any near wellbore shale or lithified rock fragments that may impede the uniform displacement of the hydrocarbon-bearing zone 145 and slurrifying the solids immediately adjacent to the wellbore.

Figure 3:
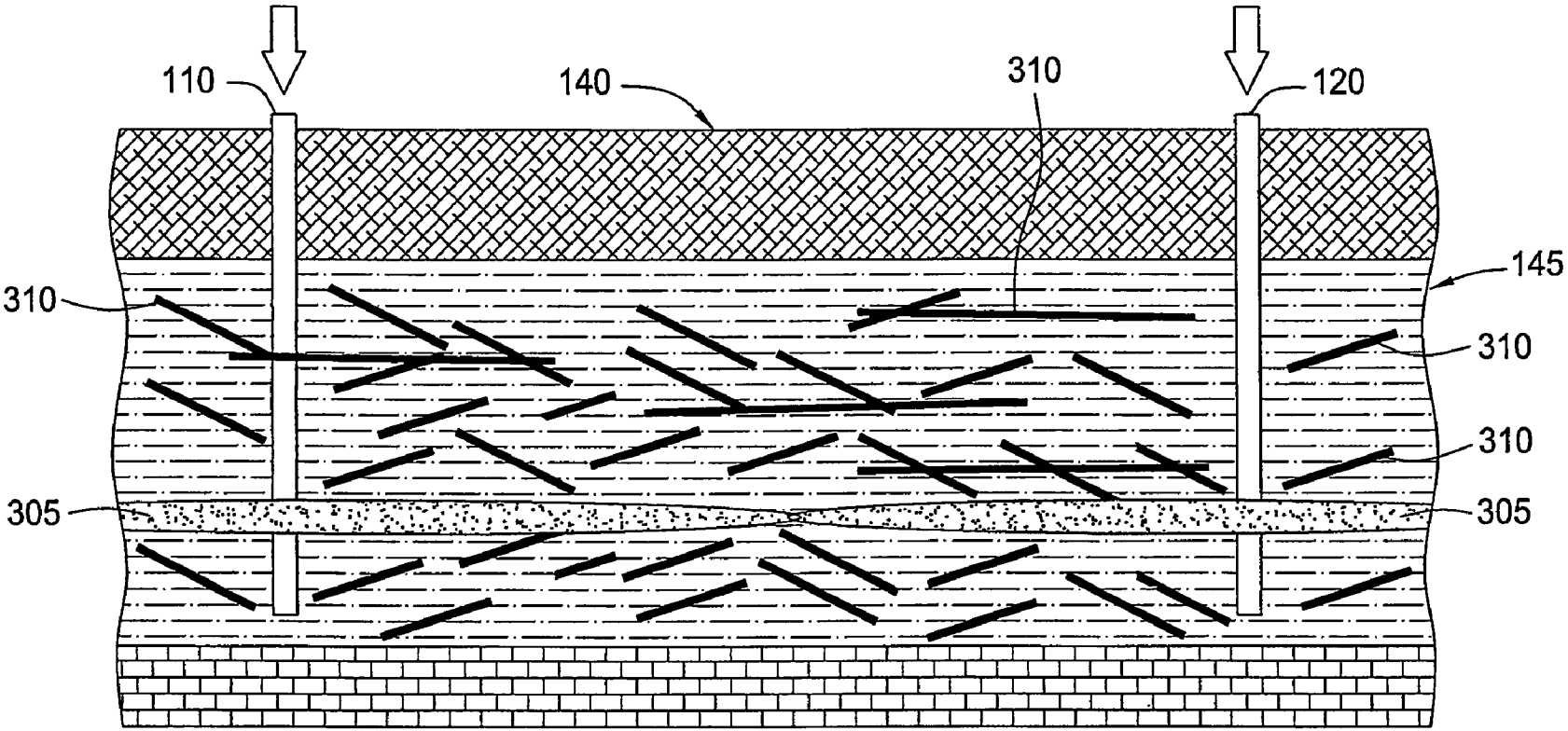
FIG. 3 is a schematic illustration for forming fractures within a formation using the injection fluid emitted from two or more wellbores.

Furthermore, the injection fluid can be emitted either simultaneously or sequentially through both wellbores 110, 120 as shown in FIG. 3 to create or cause fractures to propagate from near each wellbore 110, 120 into the formation, thereby allowing the injected fluid greater access to the formation and increasing the porosity/permeability throughout a greater area and/or volume within the hydrocarbon-bearing zone 145 more quickly. By introducing injection fluid from multiple locations within the same formation 140, the hydraulically-induced horizontal (or sub-horizontal) fractures and/or natural flow conduits 305 can help access and contact a larger portion of the formation 140 with fluid than could be from the drilled wellbore alone. In addition, by injection at multiple depths within the formation and creating horizontal (or sub-horizontal) fractures at those multiple depths, the distance the injected fluid has to flow to pressurize or condition the reservoir is greatly reduced. In areas where hydraulically induced fractures may propagate in directions such that they do not contact a sufficient volume of the hydrocarbon-bearing zone, man-made or natural conduits to fluid flow may aid in accelerating the dispersement of injected fluid and pressure throughout the hydrocarbon-bearing zone. These man-made conduits could include horizontal wells, channels or wormholes created from previous fluid and solids production or natural zones of higher absolute permeability or higher water saturation (and therefore higher permeability to the injected water).

As mentioned, the injection fluid can dilate, break, or otherwise disaggregate at least a portion of the shale or mudstone layers 310 that are embedded within the hydrocarbon-bearing zone 145 of the formation 140 thereby increasing the permeability of these materials to the injected fluids. If not broken or dilated, such shale or mudstone layers can act as baffles or barriers that impede the flow of the injected fluids through the hydrocarbon-bearing zone 145. Furthermore, the injection fluid can more quickly distribute throughout the hydrocarbon-bearing zone 145 by creating additional paths 305. The injection fluid can also access a greater surface area or volume throughout the formation 140. Although the dilation or breakup of interbedded mudstones or shales is advantageous to speeding up the conditioning process, certain combinations of thickness of the hydrocarbon-bearing zone and permeability of the sand and mudstone layers may be such as to not require the interbedded mudstones or shale to be dilated or broken up to achieve conditioning in a reasonable amount of time.

In any of the embodiments above or elsewhere herein, the rate at which the injection fluid is injected into the hydrocarbon-bearing zone 145 is dependent on the size, thickness, permeability, porosity, number and spacing of wells, and depth of the zone 145 to be conditioned. For example, the injection fluid can be injected into the hydrocarbon-bearing zone 145 at a rate of from about 50 barrels per day per well to about 5,000 barrels per day per well In any of the embodiments above or elsewhere herein, the injection fluid can be injected at different depths within the formation 140 to access the hydrocarbon-bearing zone 145 therein. As mentioned above, the formation 140 can include embedded shale or mudstone layers that create baffles that prevent flow or that surround or isolate one or more hydrocarbon-bearing zones 145 within the formation 140. The injection fluid can be used to create multiple fractures at different depths, i.e. both above and below the shale or mudstone layers to access those one or more hydrocarbon-bearing zones 145 within the formation 140. The injection fluid can also be used to create multiple fractures at different depths to increase the permeability throughout the formation 140 so the overburden 130 can be supported and overburden stress relieved more quickly.

In any of the embodiments above or elsewhere herein, the injection fluid can be injected at different depths using a perforated lining or casing where certain perforations are blocked or closed at a first depth to prevent flow therethrough, allowing the injection fluid to flow through other perforations at a second depth. In another embodiment, the injection fluid can be injected through a perforated lining or casing into the zone 145 at a first depth of a vertical wellbore or first location of a horizontal wellbore, and the perforated lining or casing can then be lowered or raised to a second depth or second location where the injection fluid can be injected into the zone 145. In yet another embodiment, a tubular or work string (not shown) can be used to emit the injection fluid at variable depths by raising and lowering the tubular or work string at the surface. In yet another embodiment, two or more injection wellbores 110 at different heights could be used to create fractures in the formation 140. In general, this would remove the problem of trying to create multiple fractures from a single wellbore.

Considering the injection fluid in more detail, the injection fluid is primarily water or brine during the conditioning phase. In any of the embodiments above or elsewhere herein, the injection fluid can include water and/or one or more agents that may aid in the conditioning of the formation or in disaggregating the shales or mudstones or the production of the slurry. Suitable agents may include but are not limited to those which increase the viscosity of the injected water or chemically react with the shales or mudstones to hasten their disagregation.

In any of the embodiments above or elsewhere herein, the injection fluid can include air or other non-condensable gas, such as nitrogen for example. The ex-solution of the gas from the water can help dilate and fluidize the hydrocarbon-bearing zones 145 within the formation 140 as the solids are displaced into the lower pressure region near the production wellbore 120 where the gas could evolve from the water. In addition, the gas can help reduce the pressure drop required to lift the solids to the surface by decreasing the solids concentration and overall density of the slurry stream in the wellbore. The gas can also help maintain higher pressure near the production wellbore 120 which would minimize the chance of the overburden 130 collapsing.

Transition Phase

Once the stress from the overburden 130 is relieved and the hydrocarbon-bearing zone is conditioned, a pressure differential or pressure gradient is created between the injection wellbore 110 and the production wellbore 120. The developing or varying pressure differential between adjacent wells will cause water or brine to flow in the formation which will create fluid drag forces on solids in the formation 140. Once the pressure gradient in a given portion of the formation near the production wellbore 120 has increased to the point where it overcomes the friction holding the sand in place, the heavy oil, formation solids, and water will move or flow towards the production well. Therefore, this pressure differential moves or flows the formation 140 (sand, heavy oil, and water) toward the production wellbore 120. The flow or movement of the hydrocarbon-bearing zone 145 toward the production wellbore 120 can be referred to as "formation displacement."

It has been observed that the fluids in the hydrocarbon-bearing zone 145 (e.g., heavy oil and water) tend to flow relative to the solids and in the direction of the pressure gradient. The relative motion between the fluid and the solids creates a viscous drag ("drag force"), described by Darcy's law, on the solids tending to pull the solids towards the production well 120. This drag force is resisted, however, by the friction holding the solids in place ("frictional force"). Relieving or nearly relieving the overburden stress greatly reduces this friction, but the weight of the sand within the hydrocarbon-bearing zone and a small amount of residual overburden stress lead to a finite friction holding the sand in place. When the pressure gradient is high enough that the viscous drag force exceeds the frictional force holding the solids in place, the heavy oil, water, and solids will move in the direction of the low pressure areas of the reservoir (e.g. the producing wells).

One method to develop this pressure gradient required to displace or mobilize the formation is to continue to inject fluid into the injection wellbore as was done during conditioning, but to reverse flow in the production wells and produce water rather than inject it as was done during conditioning. The flow of water into the production well will set up a pressure gradient near the producing wells and when the pressure gradient is sufficiently large near the production wellbores a heavy oil, water, and solids slurry will start to be produced. As production continues, a pressure gradient will develop away from the production wellbores as a low pressure front propagates from the production wellbore towards the injection wellbore. As such, the zone of formation displacement will grow outward from the producing wells towards the injection wells as the pressure gradient is varied. When the zone where the pressure gradient is sufficient to cause formation displacement to occur reaches the injection wells, re-injection of cleaned sand and water slurry will be commenced. The length of time of this "transition period" from the onset of slurry production to the start of cleaned slurry re-injection will be dependent on slurry production rates, water injection rates, how the pressure gradient is varied, well spacing, and the effective permeability of the formation to the injected fluid(s).

In addition to producing fluid from the production wells while continuing fluid injection in the injection wells, a pressure gradient may be developed by increasing the rate or pressure at the injection wells above those rates or pressures used during conditioning while producing some fluid (and eventually slurry) from the production wells. The relative rates or pressures of injection and production can be tailored to allow for the necessary pressure gradients to be developed while minimizing development of very low pressures around the production wellbores that could cause problems with slurry production into the wellbore.

In any of the embodiments above or elsewhere herein, a water jetting technique can be used to emit the injection fluid into the formation 140. Preferably, the water jetting is a short, transitional step and used intermittently or for short periods of time. The water jetting technique can be performed through the injection wellbore 110 or the production wellbore 120 or both. In one or more embodiments, the water jetting is done through the production wellbore 120 after the formation 140 is conditioned to fluidize the sand and clay and create a slurry proximal to the production wellbore 120 opening allowing the slurry to be produced through the production wellbore 120. In addition, water jetting through the production wellbore 120 can remove any hard rock fragments that are too big to flow up the production wellbore 120 with the slurry. An illustrative water jetting technique is shown and described in U.S. Pat. No. 5,249,844. In addition to fluidizing a portion of the hydrocarbon-bearing zone proximal to the production wellbore, water jetting may be used to further break-up or disaggregate shale or mudstone layers proximal to the wellbore to prevent them from impeding the flow of slurry toward the production well. During the production process, the movement or displacement of the formation towards the production well may allow the build-up of shale or mudstone near the production wellbore such that the flow of slurry into the production wellbore is impeded or the pressure gradient needed to move the formation increases beyond the pressure gradient that can be maintained. In such cases, additional water jetting in the production wellbore could be used to further break-up or disaggregate those shales or mudstones proximal to the production well and allow for them to be produced thereby allowing for unimpeded slurry flow into the production wellbore.

Production Phase:

As discussed above, the hydrocarbon-bearing solids will move toward the production wellbore 120 provided the applied pressure gradient is large enough to overcome the frictional force holding the solids in place. The frictional force is proportional to the stress of the overburden 130 at the top of the hydrocarbon-bearing zone that is not balanced by the fluid pressure in the zone plus the buoyant weight of the solids within the hydrocarbon-bearing zone. In addition, there is some additional friction due to shearing forces as the displacing formation converges on the producing well and some additional friction at the base of the hydrocarbon-zone due to the viscosity of the heavy oil. Both of these forces in general will be smaller than the residual overburden and buoyant weight frictional forces.

Furthermore, minimizing the stress applied to the solids by the overburden 130 minimizes both the pressure differential needed to move the solids and the injection rate needed to create the required pressure gradient. In addition, since the pressure gradient needed to displace the formation does not depend on the fluid viscosity (except slightly at the base) or on the permeability of the solids, as it does in conventional techniques of oil recovery, the high viscosity of the heavy oil or low relative permeability of the injection fluids does not increase the resistance to flow. As such zones within the hydrocarbon bearing zone that may have lower or high permeability or lower or higher water or oil saturation (and therefore variations in fluid mobility in the zones) do not lead to a difference in slurry production from those zones as in conventional oil recovery processes.

As mentioned above, the slurry for injection into the formation 140 contains the hydrocarbon-free or nearly hydrocarbon-free solids and recovered water from the recovery unit 170 and is recycled to the injection wellbores 110 via recycle stream 190. The solids, water, or mixture of the solids and water is then injected into the hydrocarbon-bearing zone via stream 150. Preferably, the injected slurry containing the recovered and recycled solids, water, or mixture of solids and water (i.e "re-injected slurry") can include from about 35% to about 65% percent by weight of water, and from 65% to about 35% percent by weight of solids. In one or more embodiments, the injection fluid containing the recovered and recycled solids, water, or mixture of the solids and water can include of from about 40% to about 55% percent by weight of water, and of from 60% to about 45% percent by weight of solids.

Figure 4A:
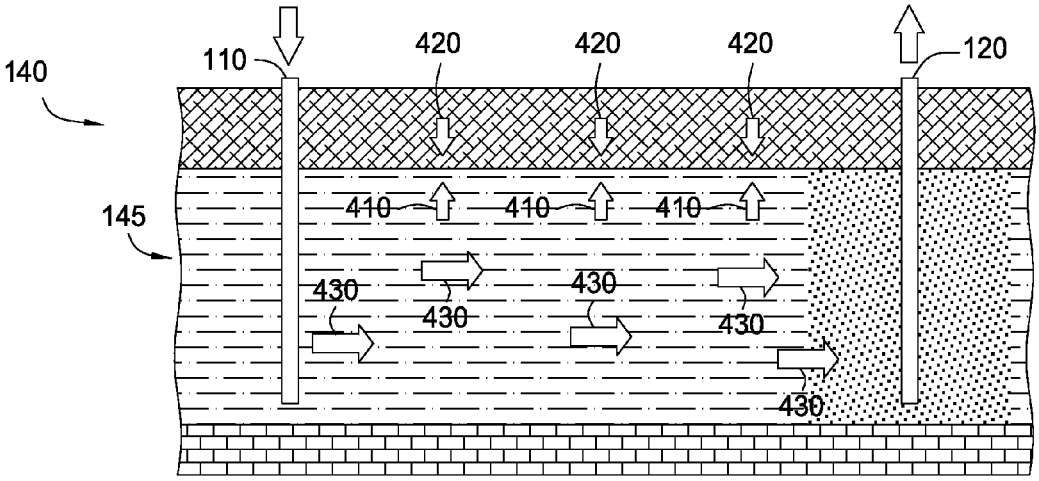
FIG. 4A is a schematic illustration to show the fluid and slurry dynamics within a formation during an early production phase.

FIG. 4A is a schematic illustration to show the fluid dynamics within the formation 140 during an early production phase. Once the pore pressure (represented by arrows 410) is essentially equal to the overburden load (represented by arrows 420), a pore pressure gradient is developed across the formation by continuing to inject water into the injection wellbore 110 and produce slurry from the production wellbore 120. When the pressure gradient (fluid drag force) exceeds the frictional force holding the formation in place, the solids (represented by arrows 430) within the hydrocarbon bearing zone 145 will start to move toward the production wellbore 120, and a heavy oil-sand-water slurry will start to be produced through the production wellbore 120.

Figure 4B:
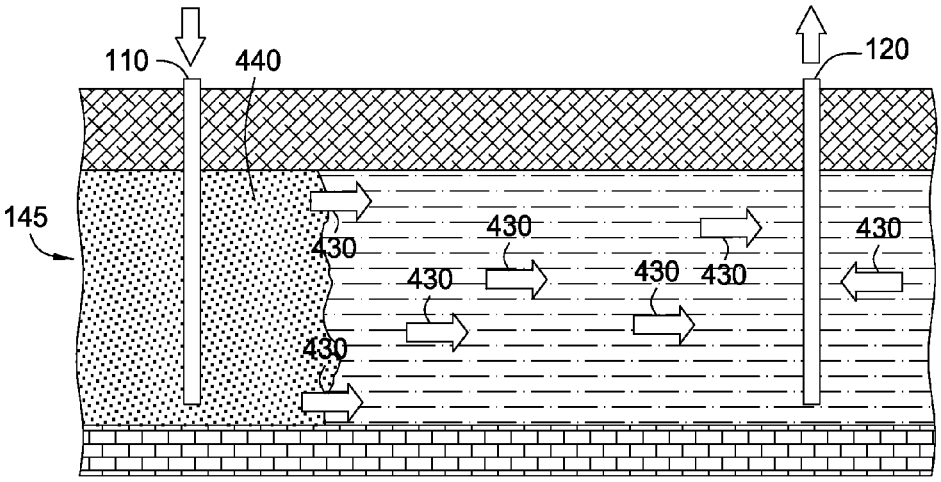
FIG. 4B is a schematic illustration showing re-injected slurry from an injection wellbore, solids displacement toward a production wellbore, and slurry production through the production wellbore.

FIG. 4B is a schematic illustration showing the re-injected slurry from the injection wellbore 110, solids 430 displacement toward the production wellbore 120, and production through the production wellbore 120. Once the pressure differential across the entire hydrocarbon-bearing zone 145 has exceeded the frictional force holding the solids in place, the solids 430 pull away from the injection wellbore 110 creating one or more voids 440. The re-injected slurry emitted from the injection wellbore 110 fills the voids 440 left by the displaced solids 430 and supplies the water needed to continue the displacement of the solids 430 toward the production wellbore 120 so additional oil-sand-water slurry can be produced through the production wellbore 120. Accordingly, the re-injected slurry serves not only to dispose of the solids 430 removed from the hydrocarbon-bearing zone 145 but more importantly, maintains the integrity of the hydrocarbon-bearing zone 145. The solids within the re-injected slurry also suppress the tendency of the injection fluid to bypass over the top of the in situ hydrocarbon-bearing solids.

Moreover, the re-injected solids will move more slowly once they enter the hydrocarbon-bearing zone if the permeability to the moving fluids is increased. This can have consequences for the optimal nature of the injected material. The permeability to water will typically be lower in the in-situ hydrocarbon-bearing solids than it would be in the same solids with the heavy oil removed. Hence, if the same solids are slurried with the water and used as the injection fluid, the in-situ hydrocarbon-bearing solids will tend to move faster in the hydrocarbon-bearing zone 145 than the reinjected solids. This can open voids in the hydrocarbon-bearing zone 145 with undesirable consequences. Therefore, it can be beneficial to add different materials to the reinjected solids to reduce the permeability to water. Optimally, this would be done in a manner so as to render the critical velocity of the mixed injected solids as it is in the in-situ hydrocarbon-bearing solids. Details of the flow dynamics within the formation 140 is more fully described in U.S. Pat. No. 5,823,631.

In the hydrocarbon-bearing zone before slurry production begins, the clay, mud, and/or fine solid particles are generally concentrated in shale or mudstone layers. As such the overall absolute permeability in the horizontal direction of the formation is often dominated by the higher permeability sand layers. In some circumstances, the amount of this clay, mud, and/or fine solids could be such that when the hydrocarbon-bearing zone is completely disaggregated by flowing as a slurry up the production well and through the heavy oil removal process, this clay, mud, and/or fine particles become more evenly disseminated in the solids that are to be reinjected with recovered water into the injection wells. The overall absolute permeability of this material once it is reinjected may be significantly lower than the original hydrocarbon zone due to the dissemination of the clay, mud, or fine solids throughout the material. As such, in these circumstances the addition of additional materials to reduce the effective permeability of the reinjected material may be significantly lessened when the percentage of clays, mud, or fine solids is sufficiently high in the original hydrocarbon-bearing zone.

Figure 5A:
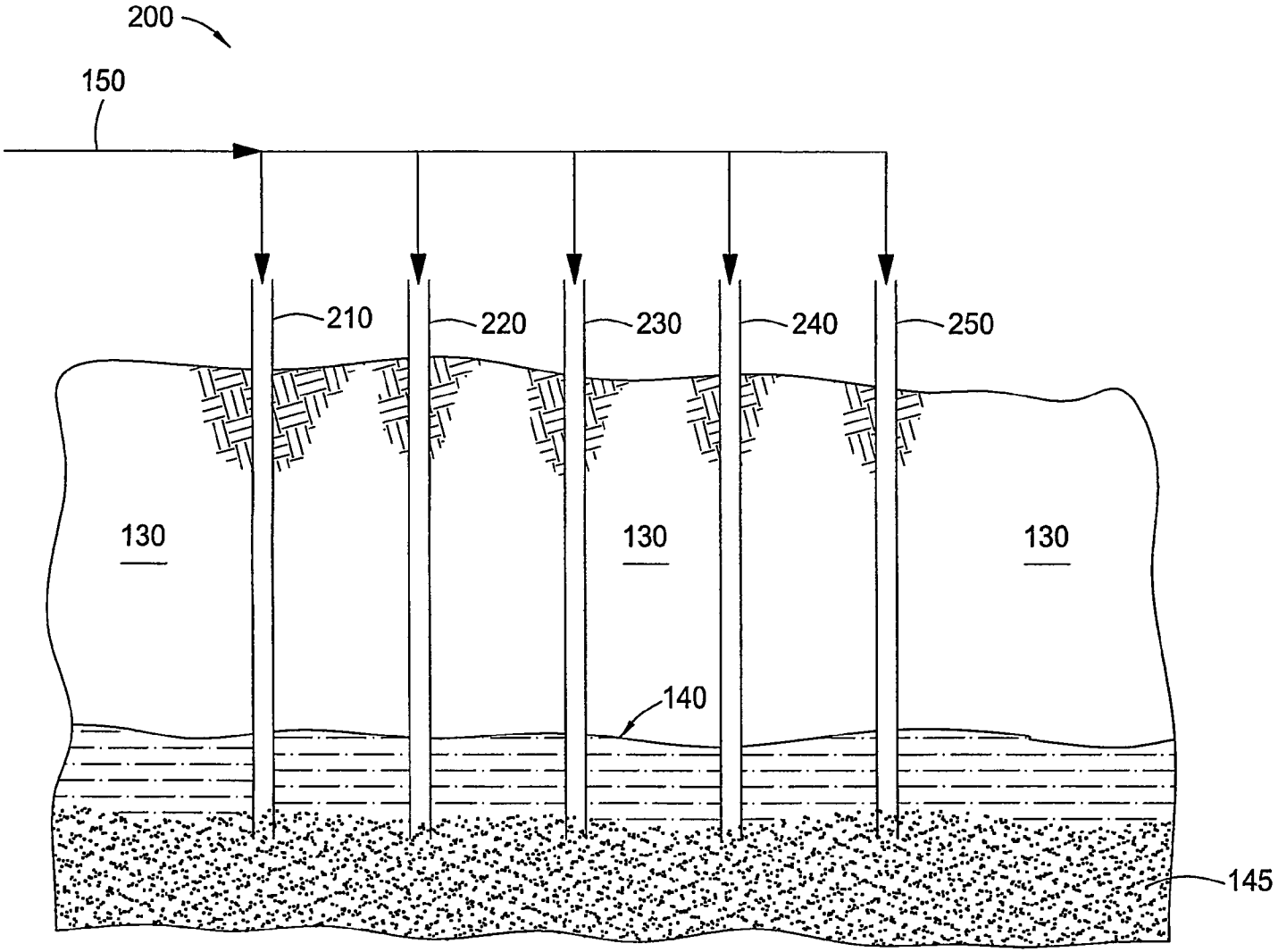
FIG. 5A is a schematic illustration of another illustrative multi-wellbore system 200 for conditioning a subsurface formation according to embodiments described.

It may also be advantageous to use one or more fluid/slurry injection techniques to locally (either spatially or temporally) increase the pressure gradient. The term "pulse" or "pulsing" refers to variations or fluctuations in fluid or slurry injection or production rate or pressure. Such fluctuations can increase the pressure gradient locally to above the threshold for displacing the sand Multi-Wellbore System FIG. 5A is a schematic illustration of another multi-wellbore system 200 for producing heavy oil from a subsurface formation according to embodiments described. The multi-wellbore system 200 can include two or more wellbores, such as five wellbores 210, 220, 230, 240 and 250 for example, as shown in FIG. 5A. During the conditioning phase, the injection fluid can be introduced into the hydrocarbon-bearing zone 145 through any one or more of the wellbores 210, 220, 230, 240 and 250. By doing so, the hydrocarbon-bearing zone 145 can be quickly conditioned. For example, any two of the wellbores 210, 220, 230, 240 and 250 can be used to pass the injection fluid to the hydrocarbon-bearing zone 145 during the conditioning phase. Alternatively, any three of the wellbores 210, 220, 230, 240 and 250 can be used to pass the injection fluid to the hydrocarbon-bearing zone 145 during the conditioning phase. Alternatively, any four of the wellbores 210, 220, 230, 240 and 250 can be used to pass the injection fluid to the hydrocarbon-bearing zone 145 during the conditioning phase. Alternatively, all five wellbores 210, 220, 230, 240 and 250 can be used to pass the injection fluid to the hydrocarbon-bearing zone 145 during the conditioning phase. As the induced hydraulic fractures or other flow conduits developed from fluid injection will likely extend outside the initial area of the injection wellbores, sections of the formation 140 outside the area of the injection wellbores are likely to be "conditioned." As such, significantly less water can be used to condition the formation 140 if water is injected into only a portion of the wellbores towards the interior of the pattern. Water injected into the peripheral wells during conditioning in the pattern is more likely to go into areas where the hydrocarbons are unlikely to be produced and reduce the efficiency of the process.

Once the formation 140 is conditioned, the injection fluid to the formation 140 is stopped through one or more of the wellbores 210, 220, 230, 240 or 250 that are to be used as production wellbores so the hydrocarbon-bearing solids in the conditioned formation 140 can be produced therethrough. For example, any two of the wellbores 210, 220, 230, 240 and 250 or any three of the wellbores 210, 220, 230, 240 and 250 or any four of the wellbores 210, 220, 230, 240 and 250 can be stopped and switched to a production wellbore. Any one or more of the water jetting, high rate injection and pressure pulsing techniques described above can be equally employed in the multi-wellbore system 200. Additionally, the injection fluid can be injected at different depths within the formation 140 to access different hydrocarbon-bearing zones 145 within the formation 140, as described above.

Figure 5B:
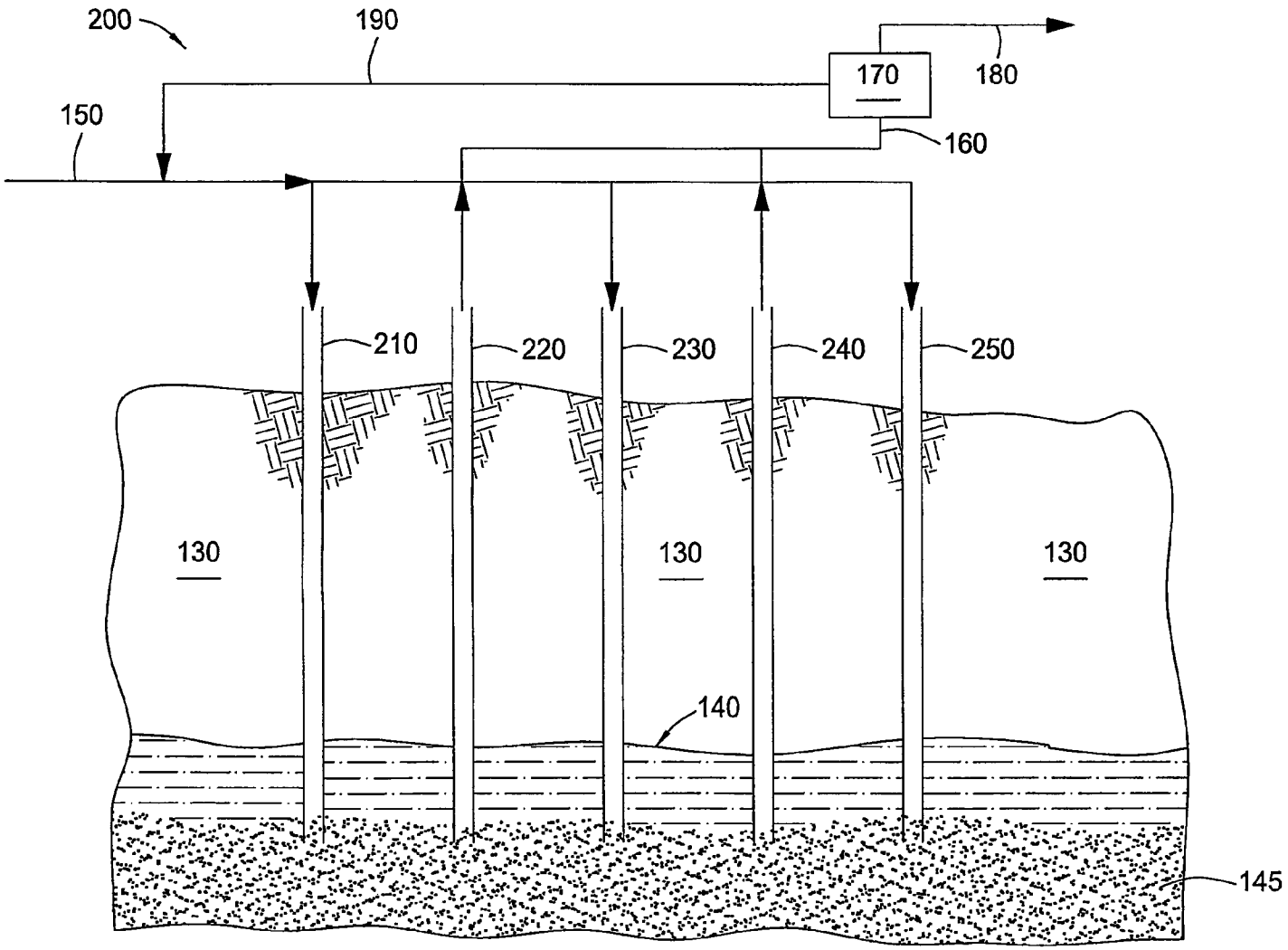
FIG. 5B is a schematic illustration of the multi-wellbore system 200 of FIG. 5A during the slurry production and slurry re-injection phase of the process.

FIG. 5B is a schematic illustration of the multi-wellbore system 200 during the production phase. After the hydrocarbon-bearing zone 145 is conditioned, the flow of injection fluid through wellbores 220 and 240 is stopped. A pore pressure gradient is developed across the formation 140 by continuing to inject fluid into the wellbores 210, 230 and 250 and produce fluids from the wellbores 220 and 240. The oil-sand-water slurry produced from the wellbores 220 and 240 (i.e. "production wellbores") is conveyed via stream 160 to the recovery unit 170. As described above, the heavy oil is separated and recovered from the solids and water within the recovery unit 170. The recovered heavy oil from the recovery unit 170 is then passed via stream 180 for further separation and refining. The hydrocarbon-free solids and recovered water from the recovery unit 170 is recycled to the wellbores 210, 230 and 250 (i.e. "injection wellbores") via recycle stream 190. The solids, water, or mixture of the solids and water ("re-injected slurry") is then injected into the formation 140 via stream 150.

As described above with reference to FIG. 4B, the solids in the hydrocarbon-bearing zone 145 of the formation 140 pull away from the injection wellbores 210, 230, and 250 once the pressure differential across the entire hydrocarbon-bearing zone 145 has exceeded the frictional force holding the solids in place, thereby creating one or more voids within the hydrocarbon-bearing zone 145. The re-injected slurry emitted from the injection wellbores 210, 230, and 250 fills those voids left by the displaced solids and supplies the water needed to continue the displacement of the solids within the hydrocarbon-bearing zone 145 toward the production wellbores 220 and 240 so additional oil-sand-water slurry can be produced.

Figure 6:
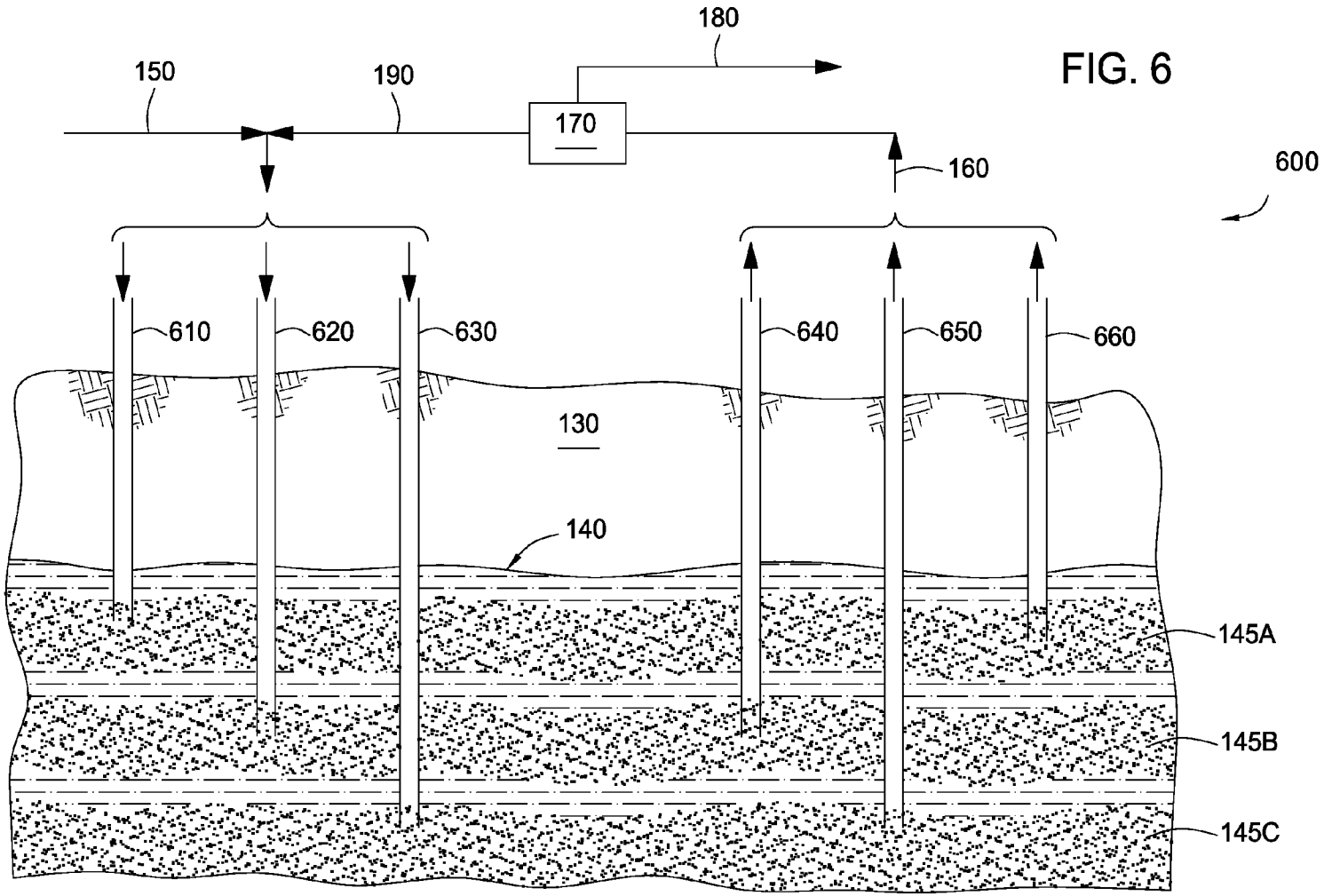
FIG. 6 is a schematic illustration of another illustrative multi-wellbore system 600 that is adapted to produce from multiple hydrocarbon-bearing zones within a formation.

FIG. 6 is a schematic illustration showing another multi-wellbore system 600 according to embodiments described. As shown, a plurality of wellbores 610, 620, 630, 640, 650, 660 are in communication with the formation 140 that includes one or more hydrocarbon-bearing zones (three are shown 145A, 145B, 145C). In one or more embodiments, at least one set or pair of wellbores, for example wellbores 610 and 660, are in communication with a first hydrocarbon-bearing zone 145A. In one or more embodiments, at least one set or pair of wellbores, for example wellbores 620 and 640, can be in communication with a second hydrocarbon-bearing zone 145B. In one or more embodiments, at least one set or pair of wellbores, for example wellbores 630 and 650, can be in communication with a third hydrocarbon-bearing zone 145C. In one or more embodiments, each set of wellbores can include at least two wellbores as shown. However, any number of wellbores can be used for a particular depth or hydrocarbon-bearing zone within the formation 140 as shown and described above with reference to FIGS. 5A and 5B.

Referring to FIG. 6, each of the three hydrocarbon-bearing zones 145A, 145B, and 145C can be conditioned and produced simultaneously or at least have some operations coexist at the same time. Alternatively, any one or more of the hydrocarbon-bearing zones 145A, 145B, and 145C can be conditioned and/or produced independently. For example, the first zone 145A can be conditioned and produced followed by the second zone 145B followed by the third zone 145C.

In one or more embodiments, the hydrocarbon-bearing zones 145A, 145B, and 145C can be conditioned and/or produced sequentially. In yet another embodiment, any one of the wellbores 610, 620, 630, 640, 650, 660 can be moved to a higher depth or lower depth as described above to condition and/or produce any one of the hydrocarbon-bearing zones 145A, 145B, and 145C, whether simultaneously, independently, or sequentially. The conditioning and production of a hydrocarbon-bearing zone has been shown and described above with references to FIGS. 1-4 and for sake of brevity, will not be repeated here. Furthermore, any one or more of the water jetting, high rate injection and pressure pulsing techniques described above can equally be employed in the multi-wellbore system 600.

Figure 7A:
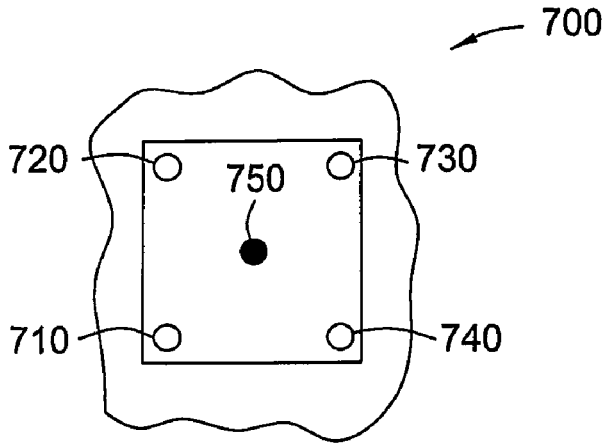
FIG. 7A is a map or plan view (horizontal slice) schematic illustration showing another illustrative multi-wellbore system 700 that is adapted to use a "five-spot" production method.

FIG. 7A is a schematic illustration showing another multi-wellbore system 700 according to embodiments described. In one or more embodiments, a "five-spot" production method can be used. In a "five-spot" production method, four wellbores 710, 720, 730, 740 are placed into the formation 140 in a configuration that resembles the four corners of a square and a fifth well 750 is drilled at the center of the square. Such an arrangement of the five wellbores 710, 720, 730, 740, 750 resembles the five on a pair of dice. In one or more embodiments, the central wellbore 750 is used as the injection wellbore to provide an elliptical production pattern emanating from the central wellbore 750 to each of the corner wellbores 710, 720, 730, 740 of which one or more can be used as production wellbores. In another embodiment, a subset of the wellbores, such as any two, three or four of the wellbores 710, 720, 730, 740, 750 can be used to pass the injection fluid to the formation 140. As such, the areal extent of the horizontal fractures from those injection wellbores will allow conditioning of the whole production area. In any of the embodiments above or elsewhere herein, all of the wellbores 710, 720, 730, 740, 750 can be used as injection wellbores when injecting fluid to relieve the stress of the overburden (i.e. during the conditioning-phase) as described above. In any of the embodiments above or elsewhere herein, any one or more of the water jetting, high rate injection, and pressure pulsing techniques as well as the multiple zone conditioning/production described above can be equally employed in the "five-spot" production method. Additionally, the injection fluid can be injected at different depths within the formation 140 to access different hydrocarbon-bearing zones 145 within the formation 140, as described above.

Figure 7B:
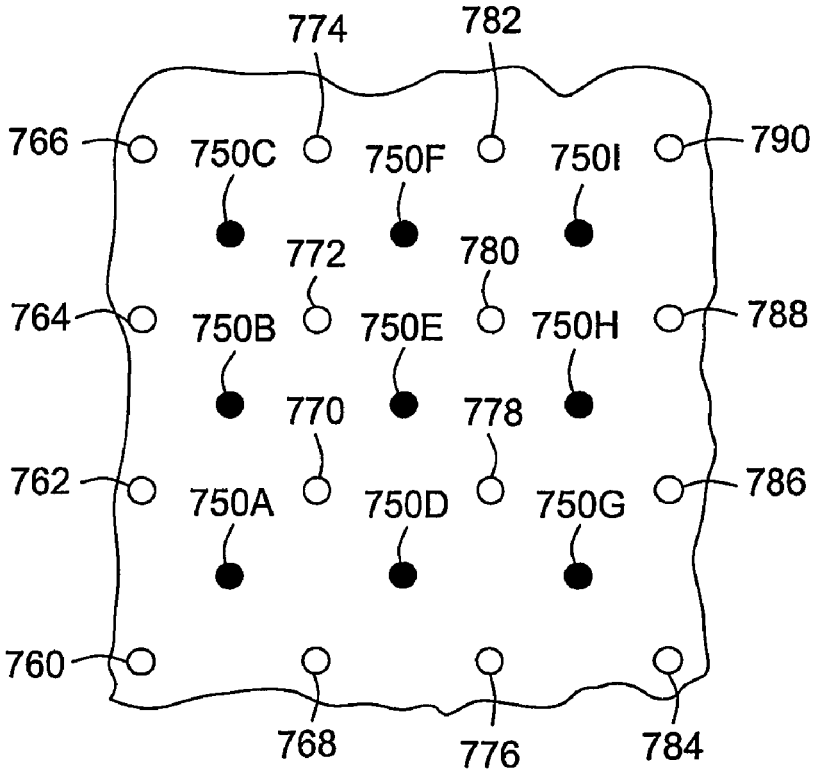
FIG. 7B shows a schematic illustration of a production area utilizing a plurality of "five spot" configurations.

FIG. 7B shows a schematic illustration of a production area utilizing a plurality of "five spot," or "five wellbore," configurations. As shown, more than one "five-spot" pattern can be used so that neighboring "five-spot" patterns share injection wells. In one or more embodiments, all the injection wellbores and all the production wellbores in a given area could be operating simultaneously during production. For example, injection wellbores 750A, 750B, 750C, 750D, 750E, 750F, 750G, 750H, 7501 can inject slurry into the formation while production wellbores 760, 762, 764, 766, 768, 770, 772, 774, 776, 778, 780, 782, 784, 786, 788, 790 produce heavy oil and sand from the formation.

In at least one specific embodiment, a centrally located wellbore can be used to inject the recycled slurry and only one of the four wellbores disposed about the fifth wellbore can be used to produce the hydrocarbon bearing slurry. After the injected recycled slurry has displaced enough of the hydrocarbon bearing formation such that the producing well starts to produce recycled slurry, this producing well is shut-in and an adjacent well of the four wellbores disposed about the fifth wellbore is operated to produce hydrocarbon from the formation. When the injected recycled slurry displaces enough hydrocarbon from the formation such that the adjacent producing well(s) start to produce recycled slurry, the adjacent producing well is shut in and another of the four wellbores disposed about the fifth wellbore is operated to produce hydrocarbon slurry. This process is repeated until all four of the wellbores disposed about the fifth wellbore have produced hydrocarbon slurry.

In one or more embodiments, there could be circumstances when it is advantageous to sequence the injection, reinjection and/or production into a series or sub-set of wellbores around a given production wellbore or injection wellbore in order to increase the total amount of production from the formation (and therefore hydrocarbon) while minimizing the "breakthrough" of reinjected sand-water-clay slurry. Breakthrough of reinjected sand-water-clay slurry occurs when the reinjected sand-water-clay slurry is produced through the production wellbores. For example, production can be maintained from any one or more production wellbores (for example well 750 in FIG. 7A) but injection and/or reinjection can be sequenced or staged through any one or more injection wellbores (710, 720, 730, or 740 in FIG. 7A) per "5 spot" pattern at any given time.

In one or more embodiments, reinjection slurry can be introduced into the formation via injection wellbore 720 while production wellbore 750 produces therefrom. Once the reinjected sand from the injector has "broken through" (i.e. produced) or near the break through point of the production wellbore 710, the injection wellbore 710 is turned off and any one or more of the other injection wellbores 720, 730, or 740 are started. It is conceivable to have only one injection wellbore operating at any given time. It is also conceivable to have two or more wellbores injecting at any given time, and there can be some overlap of injection through those two or more wellbores. Once reinjected sand from the injection well(s) (for example 720) breaks through to production well 750 or nearly breaks through, injection is stopped and the next injection well(s) (e.g. 730 and/or 740) is started and so on until sand has "broken through" from all the injection wells. A similar but more complex arrangement of sequencing would be required when more than one five-spot pattern was used.

In another embodiment, this type of sequencing process could be valuable when the geology of the production area is variable enough so that the sequenced injection-production allows production along or at right angles to natural geologic features. Early breakthrough of water during conventional water flooding due to aligned geologic features (such as high permeability zones, channelized deposits, or fractures) usually does not allow uncaptured oil in zone at right angles to the geologic features to be recovered once breakthrough occurs. The physics of this process with the movement of the porous media (i.e. hydrocarbon-bearing formation) allow such different pressure gradients to be developed in the reservoir that sequencing the wells should produce heavy oil that in conventional processes would not be recovered.

In any of the embodiments described above or elsewhere herein, slurry injection would generally stop after most of the hydrocarbon that can be produced is produced from a certain area or from a given formation layer or the injected slurry has broken through to the production well(s) and hydrocarbon-bearing slurry production has dropped below economic limits. However, water production could continue in that zone in order to feed water to another formation layer or another area for conditioning or slurry injection. Recycling of water this way could reduce the overall water needs of the process as well as minimize ground heave above the subterranean hydrocarbon-bearing formations.

In any of the embodiments described above or elsewhere herein, it may be advantageous to vary the pressure of the injection slurry and/or production wells to create pressure pulses in the formation. This could be especially important in formations where the pressure gradient across the formation needed to displace the hydrocarbon-bearing solids is greater than the pressure drop available from continuous flow. The pressure gradient within these pressure pulses may be high enough to "nudge" the formation displacement process along. In addition, the extra pressure gradient available from the pressure pulse could aid in re-starting the process after a shutdown or in widening the formation displacement lobe or displacing a portion of the formation that is not moving as easily as the rest of the formation.

Various specific embodiments are described below, at least some of which are also recited in the claims. For example, at least one other specific embodiment is directed to a method for recovering heavy oil, comprising: accessing a subsurface formation comprising heavy oil and one or more solids in two or more locations; pressurizing the formation between the locations at a pressure sufficient to relieve or nearly relive the overburden stress; causing a differential pressure between the tow or more locations to provide one or more high pressure locations and one or more low pressure locations; varying the differential pressure within the formation between the one or more high pressure locations and one or more low pressure locations to mobilize at least a portion of the solids and a portion of the heavy oil in the formation; causing the mobilized solids and heavy oil to flow toward the one or more low pressure locations to provide a slurry comprising heavy oil and one or more solids; flowing the slurry comprising heavy oil and one or more solids to the surface; recovering the heavy oil from the one or more solids; and recycling the one or more solids to the formation.

Yet another other specific embodiment is directed to a method for recovering heavy oil, comprising: accessing, from two or more locations, a subsurface formation having an overburden stress disposed thereon, the formation comprising two or more hydrocarbon-bearing zones containing heavy oil and one or more solids; injecting a fluid into the formation at two or more depths within the formation; pressurizing at least one of the two or more hydrocarbon-bearing zones within the formation to a pressure sufficient to relieve the overburden stress; causing a differential pressure within the formation to provide one or more high pressure locations and one or more low pressure locations within the at least one of the two or more hydrocarbon-bearing zones within the formation; varying the differential pressure within the formation to mobilize at least a portion of the heavy oil and a portion of the one or more solids, thereby providing mobilized one or more solids and heavy oil; causing the mobilized one or more solids and heavy oil to flow toward the one or more low pressure locations to provide a slurry comprising heavy oil and one or more solids; flowing the slurry comprising the heavy oil and one or more solids to the surface; recovering heavy oil from the slurry comprising heavy oil and one or more solids; and recycling the one or more solids to the formation.

In one or more of the methods identified above, or elsewhere herein, varying the differential pressure within the formation comprises ramping up the differential pressure.

In one or more of the methods identified above, or elsewhere herein, varying the differential pressure comprises pulsing a flow of injection fluid to one or more high pressure locations.

In one or more of the methods identified above, or elsewhere herein, varying the differential pressure within the formation comprises pulsing the flow of slurry to the surface.

In one or more of the methods identified above, or elsewhere herein, further comprises water jetting into the formation at one or more locations after pressurizing the fluid in the at least one of the two or more depths.

In one or more of the methods identified above, or elsewhere herein, recycling the one or more solids to the formation comprises displacing the heavy oil and one or more solids within the formation with a slurry comprising water and the recycled solids.

In one or more of the methods identified above, or elsewhere herein, the two or more locations are in fluid communication with a single hydrocarbon-bearing zone within the formation.

In one or more of the methods identified above, or elsewhere herein, the two or more locations are in fluid communication with two or more hydrocarbon-bearing zones within the formation.

In one or more of the methods identified above, or elsewhere herein, pressurizing the formation comprises injecting fluid into a first hydrocarbon-bearing zone within the formation followed by injecting fluid into a second hydrocarbon-bearing zone within the formation.

In one or more of the methods identified above, or elsewhere herein, pressurizing the formation comprising injecting fluid into two or more hydrocarbon-bearing zones simultaneously or near-simultaneously.

In one or more of the methods identified above, or elsewhere herein, wherein recovery of heavy oil from a first hydrocarbon-bearing zone is completed prior to starting production of heavy oil from a second hydrocarbon-bearing zone.

In one or more of the methods identified above, or elsewhere herein, production and recovery of heavy oil from the two or more hydrocarbon-bearing zones is accomplished simultaneously or nearly simultaneously.

In one or more of the methods identified above, or elsewhere herein, accessing the subsurface formation from two or more locations comprises accessing the subsurface formation from two or more wellbores. At least one of the two or more wellbores is an injection wellbore used for injecting a fluid or a slurry into the formation at one or more high pressure locations and at least one of the two or more wellbores is a production wellbore used for producing slurry and heavy oil from the formation at one or more low pressure locations.

In one or more of the methods identified above, or elsewhere herein, the two or more wellbores comprise a plurality of five wellbore sets, wherein each five wellbore set comprises four wellbores located about a centrally located fifth wellbore, some of the wellbores located around the centrally located fifth wellbore being shared by a neighboring five wellbore set.

In one or more of the methods identified above, or elsewhere herein, the centrally located fifth wellbore is used as a production wellbore. A slurry is injected into a first wellbore selected from the wellbores disposed about the centrally located fifth wellbore and injection into said first wellbore is discontinued when said slurry is produced in the centrally located fifth wellbore. Injection of a slurry into a second wellbore selected from the wellbores disposed about the centrally located fifth wellbore is then commenced and injection into said second wellbore is discontinued when said slurry is produced in the centrally located fifth wellbore. Injection of a slurry into a third wellbore selected from the wellbores disposed about the centrally located fifth wellbore is then commenced and injection into said third wellbore is discontinued when said slurry is produced in the centrally located fifth wellbore. Finally injection of a slurry into a fourth wellbore selected from the wellbores disposed about the centrally located fifth wellbore is commenced.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art. Furthermore, all patents, test procedures, and other documents cited in this application are fully incorporated by reference to the extent such disclosure is not inconsistent with this application and for all jurisdictions in which such incorporation is permitted.

Various terms have been defined above. To the extent a term used in a claim is not defined above, it should be given the broadest definition persons in the pertinent art have given that term as reflected in at least one printed publication or issued patent. Certain embodiments and features have also been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for recovering heavy oil, comprising:

accessing, from two or more locations, a subsurface formation having an overburden stress disposed thereon, the formation comprising heavy oil and one or more solids;

pressurizing the formation at a pressure;

causing a differential pressure between the two or more locations to provide one or more high pressure locations and one or more low pressure locations;

varying the differential pressure within the formation between the one or more high pressure locations and the one or more low pressure locations so as to mobilize at least a portion of the solids and a portion of the heavy oil in the formation;

causing the mobilized solids and heavy oil to flow toward the one or more low pressure locations to provide a slurry comprising heavy oil and one or more solids;

flowing the slurry comprising the heavy oil and solids to the surface;

recovering the heavy oil from the one or more solids; and recycling the one or more solids to the formation, wherein varying the differential pressure within the formation comprises pulsing the flow of the slurry in the formation.

2. The method of claim 1 wherein the pressure is sufficient to increase the permeability of the formation.

3. The method of claim 1 wherein the pressure is sufficient to disaggregate at least a portion of one or more layers within the formation.

4. The method of claim 1 wherein the pressure is sufficient to cause fractures within the formation.

5. The method of claim 1 wherein pressurizing the formation comprises injecting fluid through at least one of the two or more locations within a hydrocarbon-bearing zone of said formation.

6. The method of claim 5 wherein the fluid comprises water.

7. The method of claim 5 wherein the fluid comprises brine or other waterbased fluid.

8. The method of claim 5 wherein injecting fluid comprises injecting fluid at more than one depth within said hydrocarbon-bearing zone.

9. The method of claim 8 wherein injecting fluid at more than one depth comprises injecting fluid through a first set of the two or more locations and injecting fluid at additional depths through additional sets of the two or more locations.

10. The method of claim 1 further comprising water jetting into the formation at one or more of said two or more locations after pressurizing the formation in at least one of said two or more locations.

11. The method of claim 1 wherein varying the differential pressure within the formation comprises ramping up the differential pressure.

12. The method of claim 1 further comprising displacing the heavy oil and one or more solids within the formation with the recycled solids.

13. The method of claim 1 wherein accessing the subsurface formation from two or more locations comprises accessing the subsurface formation from two or more wellbores.

14. The method of claim 13 wherein at least one of the two or more wellbores is an injection wellbore used for injecting a fluid or a slurry into the formation at one or more high pressure locations.

15. The method of claim 13 wherein at least one of the two or more wellbores is a production wellbore used for producing slurry and heavy oil from the formation at one or more low pressure locations.

16. The method of claim 13 wherein said two or more wellbores comprise four wellbores disposed about a centrally located fifth wellbore.

17. The method of claim 16 wherein all five wellbores are used to pressurize the formation.

18. The method of claim 16 wherein the centrally located fifth wellbore is an injection wellbore and the other four are production wellbores.

19. The method of claim 16 wherein the centrally located fifth wellbore is a production wellbore and the other four are injection wellbores.

20. The method of claim 16 further comprising:

utilizing the centrally located fifth wellbore as a production wellbore;

injecting a recycle slurry comprised of recycled solids into a first wellbore selected from the wellbores disposed about the centrally located fifth wellbore;

discontinuing injecting into said first wellbore when said recycle slurry is produced in the centrally located fifth wellbore;

injecting a second slurry into a second wellbore selected from the wellbores disposed about the centrally located fifth wellbore;

discontinuing injecting into said second wellbore when said second slurry is produced in the centrally located fifth wellbore;

injecting a third slurry into a third wellbore selected from the wellbores disposed about the centrally located fifth wellbore;

discontinuing injecting into said third wellbore when said third slurry is produced in the centrally located fifth wellbore; and injecting a fourth slurry into a fourth wellbore selected from the wellbores disposed about the centrally located fifth wellbore.

21. The method of claim 20 wherein the said two or more wellbores comprise a plurality of five wellbore sets, wherein each five wellbore set comprises four wellbores located about a centrally located fifth wellbore, each of the wellbores located around the centrally located fifth wellbore being shared by a neighboring five wellbore set.

22. The method of claim 16 further comprising:

injecting a slurry into the centrally located fifth wellbore;

producing a heavy oil slurry from a first wellbore selected from the wellbores disposed about the centrally located fifth wellbore;

discontinuing producing said heavy oil slurry from said first wellbore when said injected slurry is produced from said first wellbore;

repeating the above steps for each of the other wellbores disposed about the centrally located fifth wellbore.

23. The method of claim 13 wherein the said two or more wellbores comprise a plurality of five wellbore sets, wherein each five wellbore set comprises four wellbores located about a centrally located fifth wellbore, each of the wellbores located around the centrally located fifth wellbore being shared by a neighboring five wellbore set.

24. The method of claim 1, wherein the recycling the one or more solids to the formation commences after formation displacement is detected at the one or more high pressure locations.

25. A method for recovering heavy oil, comprising:

accessing, from two or more locations, a subsurface formation having an overburden stress disposed thereon, the formation comprising one or more hydrocarbon-bearing zones containing heavy oil and one or more solids;

injecting a fluid into the formation at two or more depths within one of the one or more hydrocarbon-bearing zones of the formation;

pressurizing at least one of the one or more hydrocarbon-bearing zones within the formation to a pressure sufficient to disaggregate or bring to mechanical failure at least a portion of the formation;

causing a differential pressure within the formation to provide one or more high pressure locations and one or more low pressure locations within the at least one of the one or more hydrocarbon-bearing zones within the formation;

varying the differential pressure within the formation to mobilize at least a portion of the heavy oil and a portion of the one or more solids, thereby providing mobilized one or more solids and heavy oil;

causing the mobilized one or more solids and heavy oil to flow toward the one or more low pressure locations to provide a slurry comprising heavy oil and one or more solids;

flowing the slurry comprising the heavy oil and one or more solids to the surface;

recovering heavy oil from the slurry comprising heavy oil and one or more solids; and recycling the one or more solids to the formation, wherein varying the differential pressure within the formation comprises pulsing the flow of the slurry in the formation.

26. The method of claim 25 wherein the pressure is sufficient to increase the permeability of the formation.

27. The method of claim 25 wherein the pressure is sufficient to cause fractures within the formation.

28. The method of claim 25 comprising one or more wellbores in fluid communication with a single hydrocarbon-bearing zone within the formation.

29. The method of claim 25 comprising one or more wellbores in fluid communication with two or more hydrocarbon-bearing zones within the formation.

30. The method of claim 25 wherein pressurizing the formation comprises injecting fluid into a first hydrocarbon-bearing zone within the formation followed by injecting fluid into a second hydrocarbon-bearing zone within the formation.

31. The method of claim 30 wherein the fluid comprises water.

32. The method of claim 30 wherein the fluid comprises brine or other water based-fluid.

33. The method of claim 25 wherein pressurizing the formation comprises injecting fluid into two or more hydrocarbon-bearing zones.

34. The method of claim 25 wherein recovery of heavy oil from a first hydrocarbon-bearing zone is completed prior to starting production of heavy oil from a second hydrocarbon-bearing zone.

35. The method of claim 25 wherein production and recovery of heavy oil from the two or more hydrocarbon-bearing zones is accomplished simultaneously.

36. The method of claim 25 wherein varying the differential pressure within the formation comprises ramping up the differential pressure.

37. The method of claim 25 further comprising water jetting into the formation at one or more of the two or more locations after injecting the fluid in the two or more depths.

38. The method of claim 25 further comprising displacing the heavy oil and one or more solids within the formation with the recycled solids.

39. A method for recovering heavy oil, comprising:

accessing, from two or more locations, a subsurface formation having an overburden stress disposed thereon, the formation comprising one or more hydrocarbon-bearing zones containing heavy oil and one or more solids;

conditioning the subsurface formation through at least one of the two or more locations by pressurizing the formation at a pressure;

transitioning the subsurface formation by varying the pressure within the formation to mobilize at least a portion of the heavy oil and a portion of the one or more solids, thereby providing mobilized one or more solids and heavy oil;

causing the mobilized one or more solids and heavy oil to flow toward at least one of the two or more locations to provide a slurry comprising heavy oil and one or more solids;

producing the slurry comprising heavy oil and one or more solids by flowing the slurry to the surface;

recovering heavy oil from the slurry comprising heavy oil and one or more solids to provide heavy oil and a slurry remainder; and recycling the slurry remainder to the subsurface formation, wherein varying the pressure within the formation comprises pulsing the flow of the slurry in the formation.

40. The method of claim 39, wherein pressurizing the subsurface formation comprises injecting a fluid into at least one of the one or more hydrocarbon-bearing zones of the subsurface formation.

41. The method of claim 40, wherein the fluid is injected at two or more depths within one of the one or more hydrocarbon-bearing zones of the subsurface formation.

42. The method of claim 41 wherein injecting fluid at two or more depths comprises injecting fluid through a first set of the two or more locations and injecting fluid at additional depths through additional sets of the two or more locations.

43. The method of claim 40 wherein the fluid comprises water.

44. The method of claim 40 wherein the fluid comprises brine or other water-based fluid.

45. The method of claim 40 wherein the slurry remainder comprises the one or more solids and the fluid.

46. The method of claim 39 wherein the pressure is sufficient to increase the permeability of the formation.

47. The method of claim 39 further comprising water jetting into the formation at one or more of said two or more locations after pressurizing the formation in at least one of said two or more locations.

48. The method of claim 39 wherein varying the pressure within the formation comprises ramping up the differential pressure.

49. The method of claim 39 further comprising displacing the heavy oil and one or more solids within the subsurface formation with the slurry remainder.

50. The method of claim 39 wherein accessing the subsurface formation from two or more locations comprises accessing the subsurface formation from two or more wellbores.

51. The method of claim 50 wherein at least one of the two or more wellbores is an injection wellbore used for injecting a fluid or a slurry into the formation.

52. The method of claim 50 wherein at least one of the two or more wellbores is a production wellbore used for producing slurry and heavy oil from the formation.

53. The method of claim 50 wherein said two or more wellbores comprise four wellbores disposed about a centrally located fifth wellbore.

54. The method of claim 53 wherein all five wellbores are used to pressurize the formation.

55. The method of claim 53 wherein the centrally located fifth wellbore is an injection wellbore and the other four are production wellbores.

56. The method of claim 53 wherein the centrally located fifth wellbore is a production wellbore and the other four are injection wellbores.

57. The method of claim 53 further comprising:

utilizing the centrally located fifth wellbore as a production wellbore;

injecting a recycle slurry comprised of the remainder of the slurry comprising heavy oil and one or more solids into a first wellbore selected from the wellbores disposed about the centrally located fifth wellbore;

discontinuing injecting into said first wellbore when said recycle slurry is produced in the centrally located fifth wellbore;

injecting a second slurry into a second wellbore selected from the wellbores disposed about the centrally located fifth wellbore;

discontinuing injecting into said second wellbore when said second slurry is produced in the centrally located fifth wellbore;

injecting a third slurry into a third wellbore selected from the wellbores disposed about the centrally located fifth wellbore;

discontinuing injecting into said third wellbore when said third slurry is produced in the centrally located fifth wellbore; and injecting a fourth slurry into a fourth wellbore selected from the wellbores disposed about the centrally located fifth wellbore.

58. The method of claim 57, wherein the said two or more wellbores comprise a plurality of five wellbore sets, wherein each five wellbore set comprises four wellbores located about a centrally located fifth wellbore, each of the wellbores located around the centrally located fifth wellbore being shared by a neighboring five wellbore set.

59. The method of claim 53 further comprising:

injecting a fifth slurry into the centrally located fifth wellbore;

producing a heavy oil slurry from a first wellbore selected from the wellbores disposed about the centrally located fifth wellbore;

discontinuing producing said heavy oil slurry from said first wellbore when said fifth slurry is produced from said first wellbore;

repeating the above steps for each of the other wellbores disposed about the centrally located fifth wellbore.

60. The method of claim 50 wherein the said two or more wellbores comprise a plurality of five wellbore sets, wherein each five wellbore set comprises four wellbores located about a centrally located fifth wellbore, each of the wellbores located around the centrally located fifth wellbore being shared by a neighboring five wellbore set.

61. The method of claim 39, wherein varying the pressure within the formation continues while flowing the slurry to the surface and recycling the slurry remainder to the formation.

* * * * *